US010309653B2

(12) United States Patent
Melton et al.

(10) Patent No.: US 10,309,653 B2
(45) Date of Patent: Jun. 4, 2019

(54) BUNDLED TUBE FUEL NOZZLE WITH INTERNAL COOLING

(71) Applicant: General Electric Company, Schenectady, NY (US)

(72) Inventors: Patrick Benedict Melton, Horse Shoe, NC (US); David William Cihlar, Greenville, SC (US); Timothy James Purcell, Greenville, SC (US)

(73) Assignee: General Electric Company, Schenectady, NY (US)

( * ) Notice: Subject to any disclaimer, the term of this patent is extended or adjusted under 35 U.S.C. 154(b) by 486 days.

(21) Appl. No.: 15/060,688

(22) Filed: Mar. 4, 2016

(65) Prior Publication Data

US 2017/0254539 A1 Sep. 7, 2017

(51) Int. Cl.

| | |
|---|---|
| ***F23R 3/00*** | (2006.01) |
| ***F23R 3/08*** | (2006.01) |
| ***F23R 3/28*** | (2006.01) |
| ***F23D 14/02*** | (2006.01) |
| ***F23D 14/64*** | (2006.01) |

(52) U.S. Cl.

CPC ..... *F23R 3/283* (2013.01); *F23D 14/02* (2013.01); *F23D 14/64* (2013.01); *F23R 3/005* (2013.01); *F23R 3/08* (2013.01); *F23R 3/286* (2013.01); *F23D 2206/10* (2013.01)

(58) Field of Classification Search

CPC .. F23R 3/00; F23R 3/283; F23D 14/02; F23D 14/64; F23D 2206/10

See application file for complete search history.

(56) References Cited

U.S. PATENT DOCUMENTS

| | | | | |
|---|---|---|---|---|
| 8,276,385 | B2 | 10/2012 | Zuo et al. | |
| 2004/0187498 | A1* | 9/2004 | Sprouse | F23L 15/04 60/776 |
| 2010/0031662 | A1* | 2/2010 | Zuo | F23D 14/78 60/740 |
| 2013/0074510 | A1 | 3/2013 | Berry | |
| 2013/0122435 | A1* | 5/2013 | Stoia | F23R 3/286 431/12 |

(Continued)

OTHER PUBLICATIONS

Extended European Search Report and Opinion issued in connection with corresponding EP Application No. 17157949.3 dated Jul. 18, 2017.

*Primary Examiner* — Todd E Manahan
*Assistant Examiner* — Edward G. Lent
(74) *Attorney, Agent, or Firm* — Charlotte C. Wilson; Frank A. Landgraff

(57) ABSTRACT

A bundled tube fuel nozzle includes a forward plate, a first intermediate plate and an outer sleeve defining a fuel plenum, a second intermediate plate axially spaced from the first intermediate plate where the first intermediate plate, the second intermediate plate and the outer sleeve define a purge air plenum, an aft plate axially spaced from the second intermediate plate where the second intermediate plate, the aft plate and the outer sleeve define a cooling air plenum and an annular wall that extends from the second intermediate plate to the aft plate. The annular wall defines a cooling flow channel within the bundled tube fuel nozzle. A plurality of apertures is defined proximate to a cool side of the aft plate and provide for fluid communication between the cooling flow channel and the cooling air plenum.

19 Claims, 4 Drawing Sheets

(56) References Cited

U.S. PATENT DOCUMENTS

| | | | | |
|---|---|---|---|---|
| 2013/0213051 | A1* | 8/2013 | Westmoreland, III | F23R 3/286 60/775 |
| 2015/0000284 | A1 | 1/2015 | LeBegue et al. | |
| 2015/0076251 | A1 | 3/2015 | Berry | |
| 2015/0167982 | A1 | 6/2015 | Bellino et al. | |

* cited by examiner

BUNDLED TUBE FUEL NOZZLE WITH INTERNAL COOLING

FIELD OF THE TECHNOLOGY

The present invention generally involves a bundled tube fuel nozzle for a gas turbine combustor. More specifically, the invention relates to a bundled tube fuel nozzle with internal cooling.

BACKGROUND

Gas turbines are widely used in industrial and power generation operations. A gas turbine generally includes, in serial flow order, a compressor, a combustion section and a turbine. The combustion section may include multiple combustors annularly arranged around an outer casing. In operation, a working fluid such as ambient air is progressively compressed as it flows through the compressor. A portion of the compressed working fluid is routed from the compressor to each of the combustors where it is mixed with a fuel and burned in a combustion chamber or zone to produce combustion gases. The combustion gases are routed through the turbine along a hot gas path where thermal and/or kinetic energy is extracted from the combustion gases via turbine rotors blades coupled to a rotor shaft, thus causing the rotor shaft to rotate and produce work and/or thrust.

Particular combustion systems utilize bundled tube type fuel nozzles for premixing a gaseous fuel with the compressed air upstream from the combustion zone. An aft plate of the bundled tube fuel nozzle is disposed at a downstream end of the bundled tube fuel nozzle. A "hot side" of the aft plate is positioned proximate to outlets of each tube of the bundle tube fuel nozzle. As such, the hot side of the aft plate is exposed to extreme heat from the combustion gases.

BRIEF DESCRIPTION OF THE TECHNOLOGY

Aspects and advantages are set forth below in the following description, or may be obvious from the description, or may be learned through practice.

One embodiment of the present disclosure is a bundled tube fuel nozzle. The bundled tube fuel nozzle includes a forward plate, a first intermediate plate and an outer sleeve defining a fuel plenum therebetween. A second intermediate plate is axially spaced from the first intermediate plate and the first intermediate plate, the second intermediate plate and the outer sleeve define a purge air plenum therebetween. An aft plate is axially spaced from the second intermediate plate. The second intermediate plate, the aft plate and the outer sleeve define a cooling air plenum therebetween. A plurality of tubes extends through the forward plate, the fuel plenum, the first intermediate plate, the purge air plenum, the second intermediate plate, the cooling air plenum and the aft plate. An annular wall extends from the second intermediate plate to the aft plate and defines a cooling flow channel. A plurality of apertures is defined proximate to a cool side of the aft plate. The plurality of apertures provide for fluid communication between the cooling flow channel and the cooling air plenum.

Another embodiment of the present disclosure is a combustor. The combustor includes an end cover coupled to an outer casing and a bundled tube fuel nozzle disposed within the outer casing and coupled to the end cover via one or more fluid conduits. The bundled tube fuel nozzle comprises a forward plate, a first intermediate plate and an outer sleeve that define a fuel plenum therebetween. The fuel plenum is in fluid communication with the fluid conduit. A second intermediate plate is axially spaced from the first intermediate plate. The first intermediate plate, the second intermediate plate and the outer sleeve define a purge air plenum therebetween. An aft plate is axially spaced from the second intermediate plate. The second intermediate plate, the aft plate and the outer sleeve define a cooling air plenum therebetween. A plurality of tubes extends through the forward plate, the fuel plenum, the first intermediate plate, the purge air plenum, the second intermediate plate, the cooling air plenum and the aft plate. An annular wall extends from the second intermediate plate to the aft plate and defines a cooling flow channel within the bundled tube fuel nozzle. A plurality of apertures is defined proximate to a cool side of the aft plate. The plurality of apertures provide for fluid communication between the cooling flow channel and the cooling air plenum.

Another embodiment includes a combustor. The combustor includes an end cover coupled to an outer casing and a bundled tube fuel nozzle disposed within the outer casing and coupled to the end cover via a plurality of fluid conduits. The bundled tube fuel nozzle comprises a plurality of bundled tube fuel nozzle assemblies annularly arranged about a center fuel nozzle of the combustor. Each bundled tube fuel nozzle assembly comprises a forward plate, a first intermediate plate and an outer sleeve defining a fuel plenum therebetween. The fuel plenum is in fluid communication with at least one fluid conduit of the plurality of fluid conduits. A second intermediate plate is axially spaced from the first intermediate plate. The first intermediate plate, the second intermediate plate and the outer sleeve define a purge air plenum therebetween. An aft plate is axially spaced from the second intermediate plate. The second intermediate plate, the aft plate and the outer sleeve define a cooling air plenum therebetween. A plurality of tubes extends through the forward plate, the fuel plenum, the first intermediate plate, the purge air plenum, the second intermediate plate, the cooling air plenum and the aft plate. An annular wall extends from the second intermediate plate to the aft plate and defines a cooling flow channel within the bundled tube fuel nozzle. A plurality of apertures is defined proximate to a cool side of the aft plate. The plurality of apertures provides for fluid communication between the cooling flow channel and the cooling air plenum during operation of the combustor.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
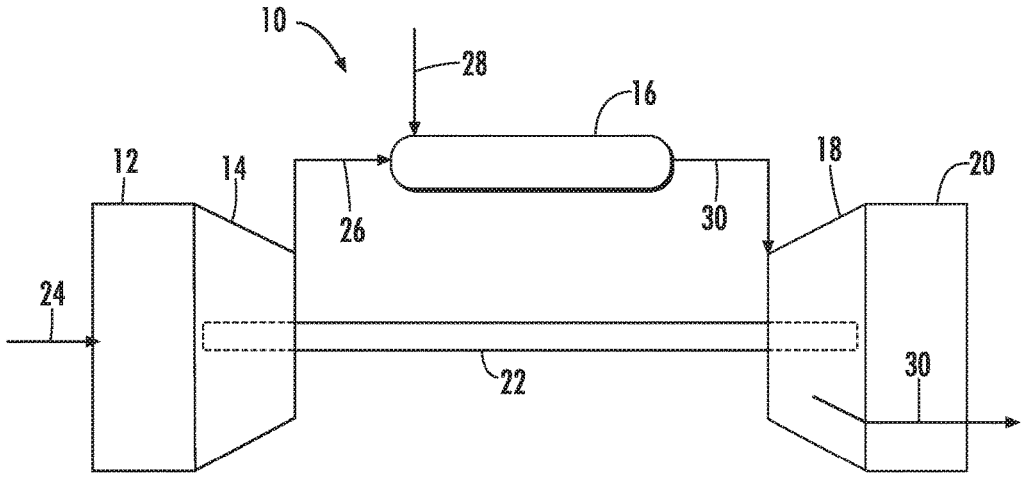
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, and the term "axially" refers to the relative direction that is substantially parallel and/or coaxially aligned to an axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a bundled tube fuel nozzle for a land based power generating gas turbine combustor for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes an inlet section 12, a compressor 14 disposed downstream of the inlet section 12, at least one combustor 16 disposed downstream of the compressor 14, a turbine 18 disposed downstream of the combustor 16 and an exhaust section 20 disposed downstream of the turbine 18. Additionally, the gas turbine 10 may include one or more shafts 22 that couple the compressor 14 to the turbine 18.

During operation, air 24 flows through the inlet section 12 and into the compressor 14 where the air 24 is progressively compressed, thus providing compressed air 26 to the combustor 16. At least a portion of the compressed air 26 is mixed with a fuel 28 within the combustor 16 and burned to produce combustion gases 30. The combustion gases 30 flow from the combustor 16 into the turbine 18, wherein energy (kinetic and/or thermal) is transferred from the combustion gases 30 to rotor blades (not shown), thus causing shaft 22 to rotate. The mechanical rotational energy may then be used for various purposes such as to power the compressor 14 and/or to generate electricity. The combustion gases 30 exiting the turbine 18 may then be exhausted from the gas turbine 10 via the exhaust section 20.

Figure 2:
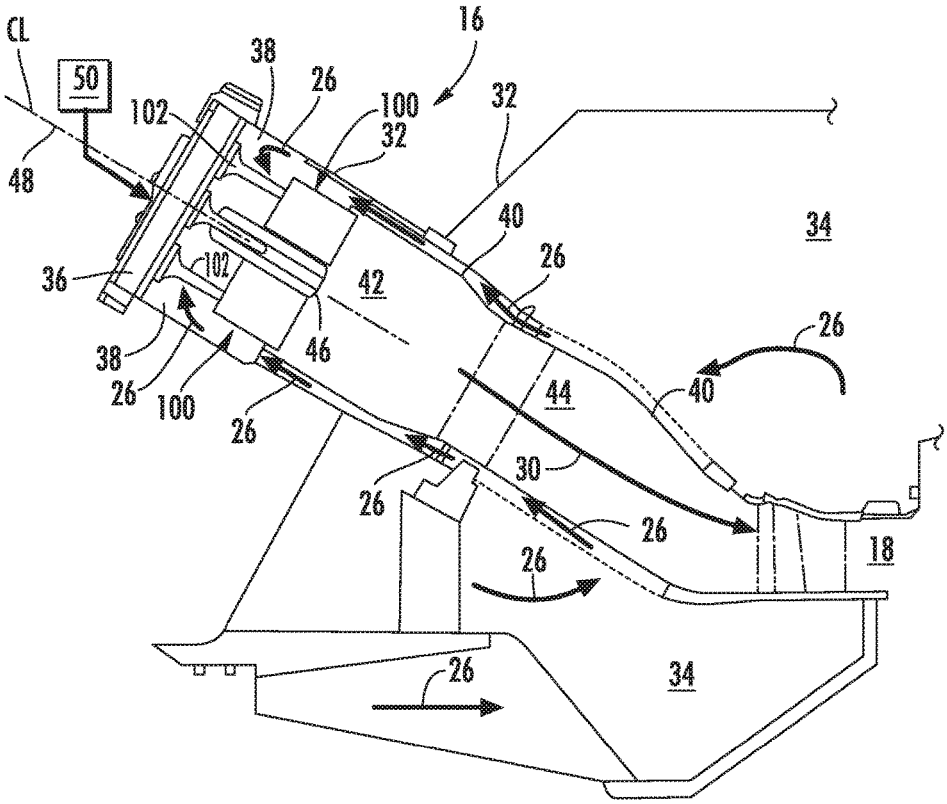
FIG. 2 is a simplified cross-section side view of an exemplary combustor as may incorporate various embodiments of the present disclosure.

As shown in FIG. 2, the combustor 16 may be at least partially surrounded an outer casing 32 such as a compressor discharge casing. The outer casing 32 may at least partially define a high pressure plenum 34 that at least partially surrounds various components of the combustor 16. The high pressure plenum 34 may be in fluid communication with the compressor 14 (FIG. 1) so as to receive the compressed air 26 therefrom. An end cover 36 may be coupled to the outer casing 32. In particular embodiments, the outer casing 32 and the end cover 36 may at least partially define a head end volume or portion 38 of the combustor 16. In particular embodiments, the head end portion 38 is in fluid communication with the high pressure plenum 34 and/or the compressor 14. One or more liners or ducts 40 may at least partially define a combustion chamber or zone 42 for combusting the fuel-air mixture and/or may at least partially define a hot gas path 44 through the combustor for directing the combustion gases 30 towards an inlet to the turbine 18. In particular embodiments, as shown in FIG. 2, the combustor 16 includes a center fuel nozzle 46 coupled to the end cover 36 and extending axially towards the combustion chamber 42 with respect to an axial centerline 48 of the combustor 16.

In various embodiments, the combustor 16 includes a bundled tube fuel nozzle 100. As shown in FIG. 2, the fuel nozzle 100 is disposed within the outer casing 32 downstream from and/or axially spaced from the end cover 36 with respect to axial centerline 48 of the combustor 16 and upstream from the combustion chamber 42. In particular embodiments, the bundled tube fuel nozzle 100 is in fluid communication with a gas fuel supply 50. In one embodiment, the bundled tube fuel nozzle 100 is in fluid communication with the gas fuel supply 50 via one or more fluid conduits 102. In particular embodiments, the fluid conduit(s) 102 may be fluidly coupled and/or connected at one end to the end cover 36.

Figure 3:
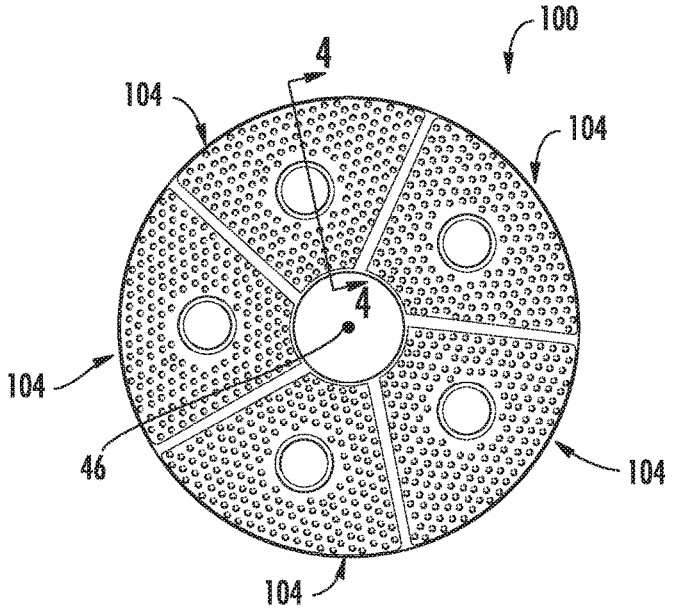
FIG. 3 is an upstream view of an exemplary bundled tube fuel nozzle according to one or more embodiments of the present disclosure.
Figure 4:
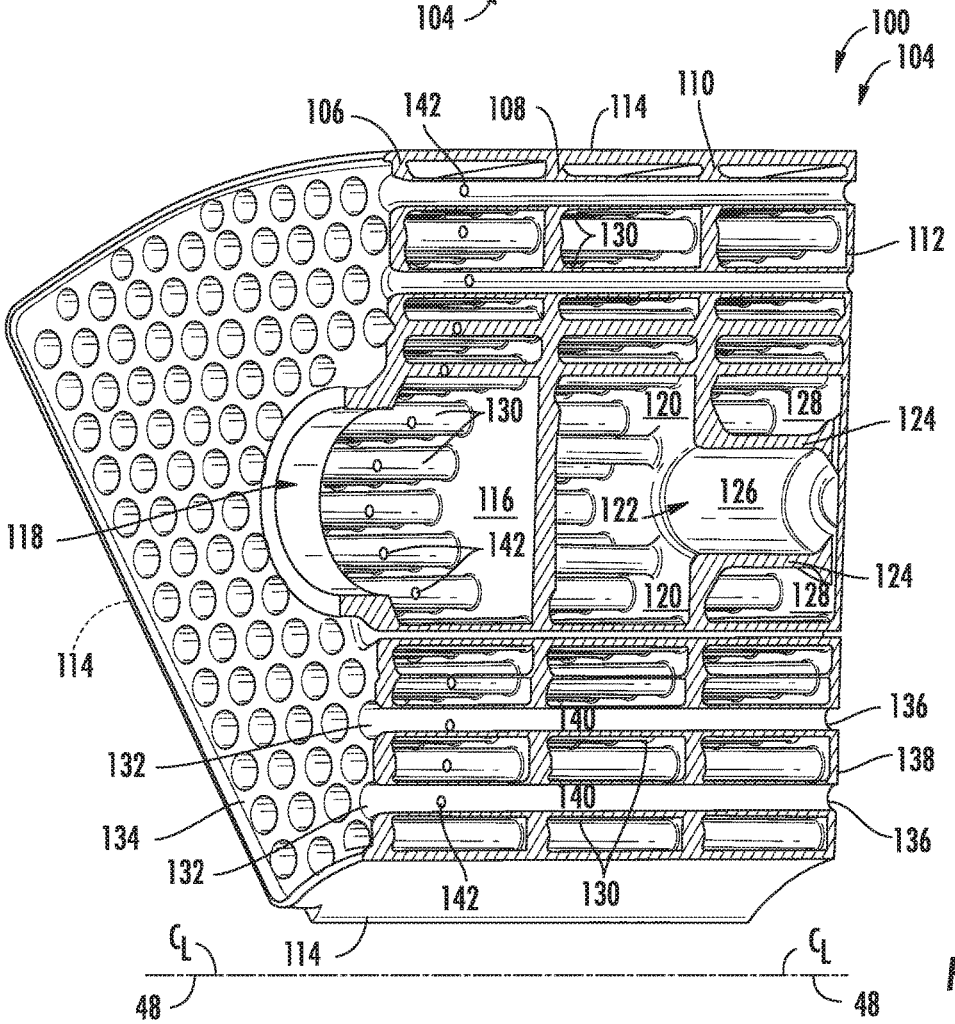
FIG. 4 is an enlarged cross sectional perspective view of a portion of the bundled tube fuel nozzle taken along section lines 4-4 as shown in FIG. 3, according to at least one embodiment of the present disclosure.

FIG. 3 provides an upstream view of an exemplary bundled tube fuel nozzle 100 according to at least one embodiment of the present disclosure. FIG. 4 provides a cross sectioned downstream perspective view of a portion of the bundled tube fuel nozzle 100 taken along section line 4-4 as shown in FIG. 3, according to at least one embodiment of the present disclosure. Various embodiments of the combustor 16 may include different arrangements of the bundled tube fuel nozzle 100 and is not limited to any particular arrangement unless otherwise specified in the claims. For example, in particular configurations as illustrated in FIG. 3, the bundled tube fuel nozzle 100 includes multiple wedge shaped bundled tube fuel nozzle assemblies 104 annularly arranged with respect to centerline 48. In particular embodiments, the bundled tube fuel nozzle 100 forms an annulus or fuel nozzle passage about a portion of the center fuel nozzle 46 (FIG. 1).

In at least one embodiment, as shown in FIG. 4, the bundled tube fuel nozzle 100 and/or each bundled tube fuel nozzle assembly 104, includes, in sequential order, a forward plate 106, a first intermediate plate 108 axially spaced from the forward plate 106, a second intermediate plate 110 axially spaced from the first intermediate plate 108, an aft plate 112 axially spaced from the second intermediate plate 110 and an outer shroud or sleeve 114 that extends about an outer perimeter or peripheral edge of the forward plate 106, the first intermediate plate 108, the second intermediate plate 110 and the aft plate 112. In at least one embodiment, the forward plate 106, first intermediate plate 108, second intermediate plate 110 and the aft plate 112 are wedge shaped with arcuate inner and outer sides.

In at least one embodiment, the forward plate 106, the first intermediate plate 108 and the sleeve 114 at least partially define a fuel plenum 116 within the bundled tube fuel nozzle 100. The forward plate 106 may define an opening 118 to the fuel plenum 116. The opening 118 may be fluidly coupled to the fluid conduit 102 (FIG. 2). The first intermediate plate 108, the second intermediate plate 110 and the sleeve 114 at least partially define a purge air plenum 120 within the bundled tube fuel nozzle 100. The second intermediate plate 110 defines a hole or passage 122. In particular embodiments the passage 122 may be substantially aligned with the opening 118 of the forward plate 106. An annular wall 124 extends axially from the second intermediate plate 110 to the aft plate 112 and is aligned with the passage 122. The passage 122 and the wall 124 at least partially form a cooling flow channel 126 within the bundled tube fuel nozzle 100. The second intermediate plate 110, the aft plate 112, the wall 124 and the outer sleeve 114 at least partially define a cooling air plenum 128 within the bundled tube fuel nozzle 100 and/or the bundled tube fuel nozzle assembly 104.

As shown in FIG. 4, the bundled tube fuel nozzle 100 and/or the bundled tube fuel nozzle assembly 104 includes a plurality of tubes 130 that extends through the forward plate 106, the fuel plenum 116, the first intermediate plate 108, the purge air plenum 120, the second intermediate plate 110, the cooling air plenum 128 and through the aft plate 112. Each tube 130 includes an inlet 132 defined at or upstream from an upstream side 134 of the forward plate 106 and an outlet 136 defined at or downstream from a downstream or hot side 138 of the aft plate 112. Each tube 130 defines a premix flow passage 140 through the bundled tube fuel nozzle 100 and/or the bundled tube fuel nozzle assembly 104. One or more of the tubes 130 includes at least one fuel injection port 142 which provides for fluid communication between the fuel plenum 116 and the respective premix flow passage 140. In at least one embodiment, as shown in FIG. 4, the plurality of tubes 130 is annularly arranged around the opening 118 in the forward plate 106.

Figure 5:
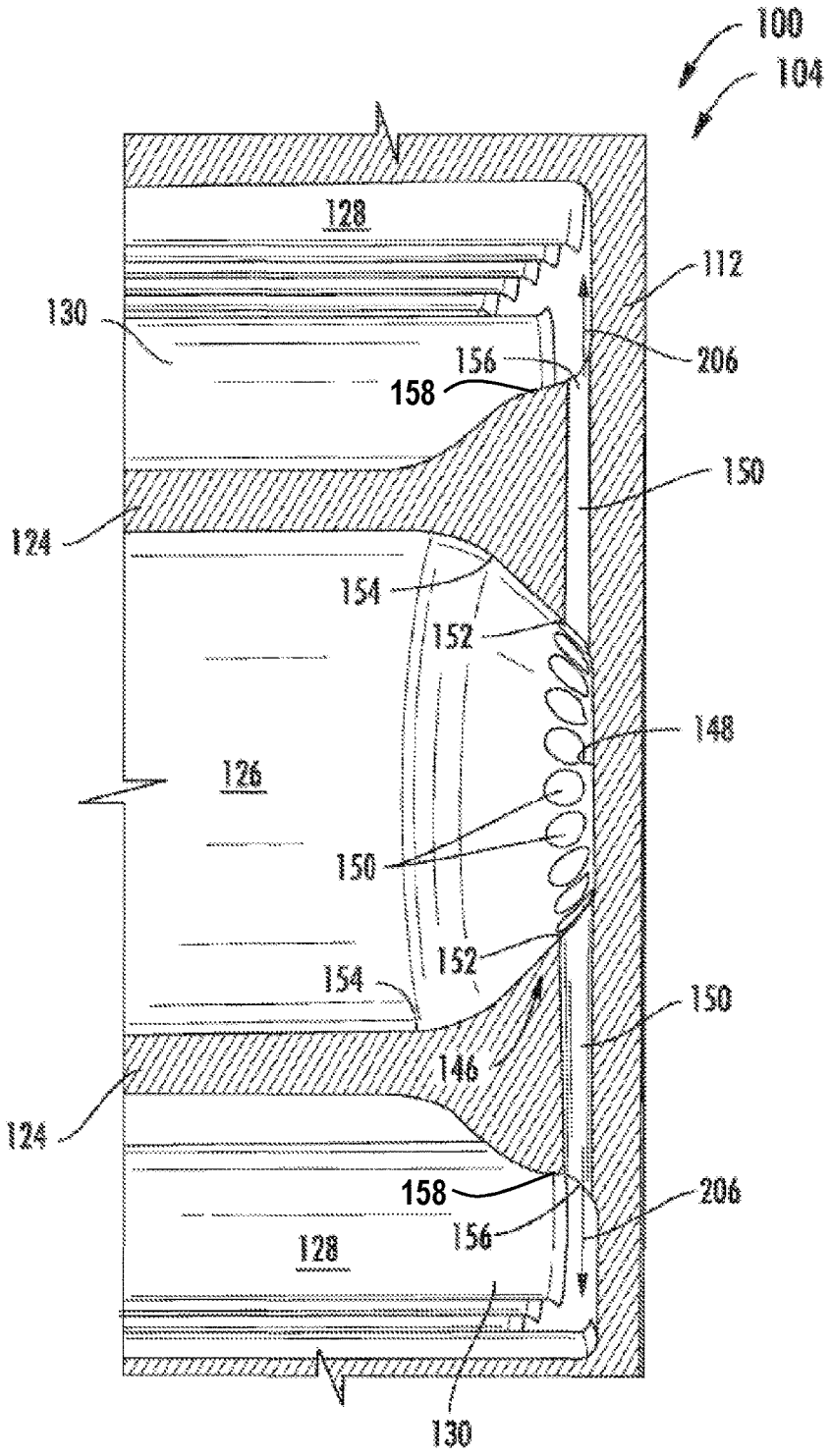
FIG. 5 is an enlarged view of a portion of the bundled tube fuel nozzle as shown in FIG. 4, according to at least one embodiment of the present disclosure.

FIG. 5 is an enlarged cross sectional side view of a portion of the bundled tube fuel nozzle 100 or one of the bundled tube fuel nozzle assemblies 104 as shown in FIGS. 3 and 4, including a portion of the aft plate 112, a portion of wall 124 and a portion of the cooling air plenum 128 according to at least one embodiment of the present disclosure. As shown in FIGS. 4 and 5, a downstream end portion 146 of the wall 124 and/or a cool side 148 of the aft plate 112 which is axially spaced from the downstream or hot side 138 of the aft plate 112 defines a plurality of apertures 150 circumferentially spaced thereabout. As shown in detail in FIG. 5, each aperture 150 includes an inlet 152 defined along an inner surface 154 of the wall 124 and/or along the cool side 148 of the aft plate 112, and an outlet 156 defined along an outer surface 158 of the wall 124 and/or along the cool side 148 of the aft plate 112. In at least one embodiment, one or more of the inlets 152 is disposed proximate or adjacent to the cool side 148 of the aft plate 112. In at least one embodiment, one or more of the outlets 156 is oriented towards the cool side 148 of the aft plate 112. During operation, the apertures 150 provide for fluid communication from the cooling flow channel 126 to the cooling air plenum 128.

Figure 6:
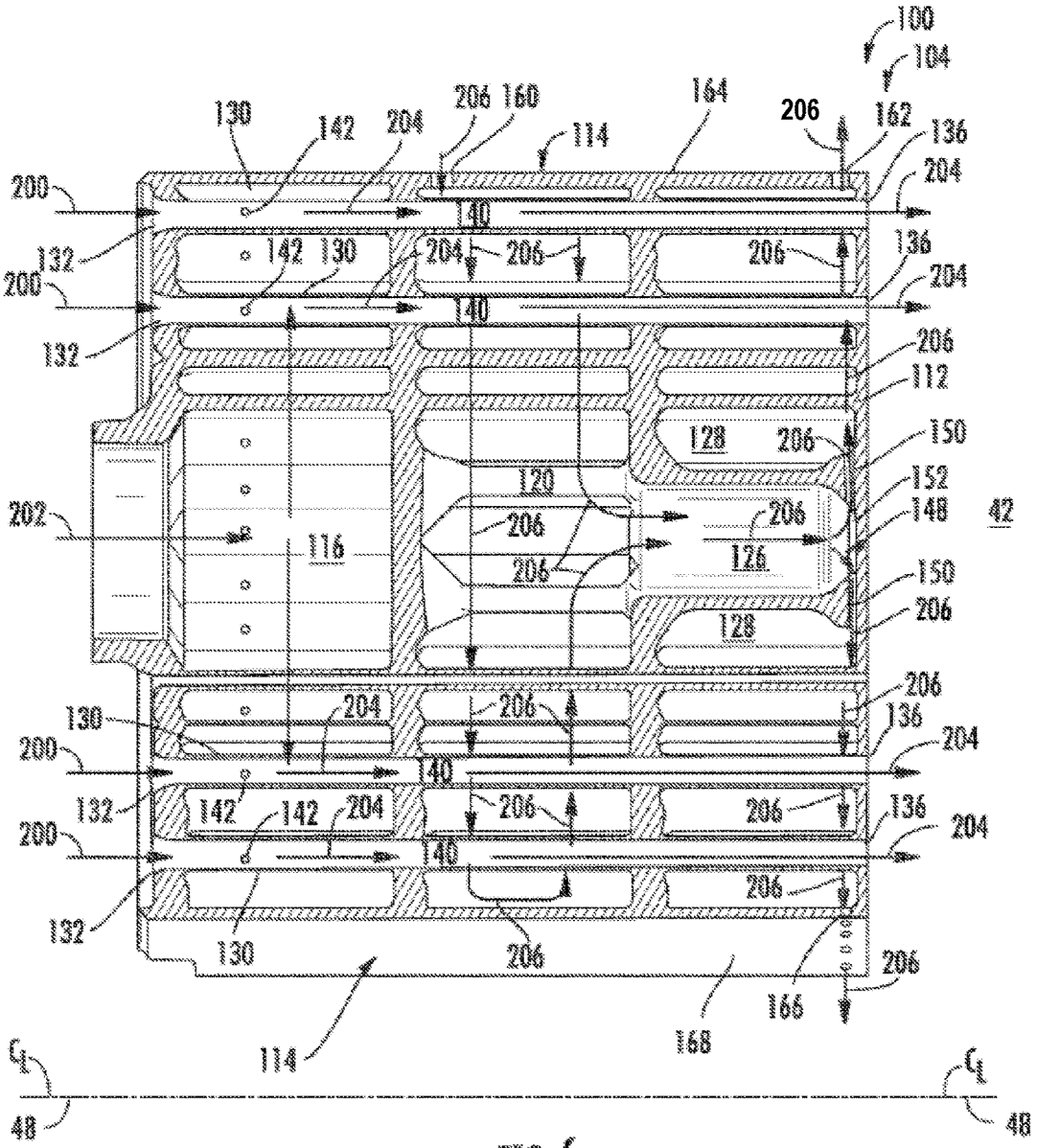
FIG. 6 is an operational diagram of the bundled tube fuel nozzle as shown in FIG. 4, according to at least one embodiment of the present disclosure.

FIG. 6 provides an operational flow diagram of the bundled tube fuel nozzle 100 according to at least one embodiment of the present disclosure. During operation, as shown in FIG. 6, compressed air 200 such as the compressed air 26 from the compressor 14 enters the respective inlet 132 of each tube 130. Fuel 202 flows into and pressurizes the fuel plenum 116 via the fluid conduit 102 (FIG. 2). The fuel 202 is injected into the premix flow passage 140 of one or more of the tubes 130 via fuel injection port(s) 142. The fuel 202 and compressed air 200 mix or blend together within the respective premix flow passages 140 to form a combustible fuel-air mixture 204 which exits the respective tube outlets 136 and is burned in the combustion chamber 42.

An inert gas 206 such as compressed air 26 is injected or flows into the purge air plenum 120 via at least one inlet port 160 defined along the outer sleeve 114. The inert gas 206 flows across a portion of the tubes 130 that extends through the purge air plenum 120, thus providing cooling to the tubes 130 and/or the outer sleeve 114. The inert gas 206 may also purge any fuel which may have leaked from the fuel plenum 116 into the purge air plenum 120. A pressure differential between the purge air plenum 120 and the cooling air plenum 128 causes the inert gas 206 to travel through the cooling flow channel 126, towards the cold side 148 of the aft plate 112, into the respective inlets 152 of each aperture 150 and into the cooling air plenum 128.

As shown in FIGS. 5 and 6 collectively, one or more of the outlets 156 of the apertures 150 may be oriented so as to direct the inert gas 206 across the cold side 148 of the aft plate 112 and/or around the tubes 130 within the cooling air plenum 128, thereby providing impingement, convection and/or conductive cooling of the aft plate 112 and/or the portion of tubes 130 disposed within the cooling air plenum 128. The inert gas 206 may be exhausted from the cooling air plenum 128 via exhaust ports defined along the outer sleeve 114. In particular embodiments, one or more exhaust ports 162 are defined along an outer band 164 portion of the outer sleeve 114. In particular embodiments, one or more exhaust ports 166 are defined along an inner band portion 168 of the outer sleeve 114. The inner band portion 168 of the outer sleeve 114 may extend at least partially around the center fuel nozzle 46. As such, the exhaust ports 166 may provide cooling to a portion of the center fuel nozzle 46 and or may form a fluid seal between the inner band portion 168 and the center fuel nozzle 46.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A bundled tube fuel nozzle comprising:

a forward plate, a first intermediate plate, and an outer sleeve defining a fuel plenum therebetween;

a second intermediate plate axially spaced from the first intermediate plate, wherein the first intermediate plate, the second intermediate plate, and the outer sleeve define a purge air plenum therebetween;

an aft plate axially spaced from the second intermediate plate, wherein the second intermediate plate, the aft plate, and the outer sleeve define a cooling air plenum therebetween;

a plurality of tubes that extends through the forward plate, the fuel plenum, the first intermediate plate, the purge air plenum, the second intermediate plate, the cooling air plenum, and the aft plate, each tube of the plurality of tubes having a longitudinal tube axis;

an annular wall that extends from the second intermediate plate to the aft plate, the annular wall being surrounded by the plurality of tubes and defining a cooling flow channel, the cooling flow channel having a longitudinal channel axis that is non-coaxial with the longitudinal tube axis of each tube of the plurality of tubes; and a plurality of apertures defined proximate to a cool side of the aft plate, wherein the plurality of apertures provides for fluid communication between the cooling flow channel and the cooling air plenum.

2. The bundled tube fuel nozzle as in claim 1, wherein the apertures of the plurality of apertures are circumferentially spaced along the annular wall.

3. The bundled tube fuel nozzle as in claim 1, wherein one or more of the apertures of the plurality of apertures includes an outlet oriented towards the cool side of the aft plate.

4. The bundled tube fuel nozzle as in claim 1, wherein the outer sleeve defines an inlet port, wherein the inlet port provides for fluid communication into the purge air plenum.

5. The bundled tube fuel nozzle as in claim 1, wherein the outer sleeve defines one or more exhaust ports, wherein the one or more exhaust ports provide for fluid communication out of the cooling air plenum.

6. The bundled tube fuel nozzle as in claim 5, wherein at least one of the one or more exhaust ports is defined along an inner band portion of the outer sleeve.

7. The bundled tube fuel nozzle as in claim 5, wherein at least one of the one or more exhaust ports is defined along an outer band portion of the outer sleeve.

8. A combustor comprising:

an end cover coupled to an outer casing;

a bundled tube fuel nozzle disposed within the outer casing and coupled to the end cover via one or more fluid conduits, wherein the bundled tube fuel nozzle comprises:

a forward plate, a first intermediate plate, and an outer sleeve defining a fuel plenum therebetween, wherein the fuel plenum is in fluid communication with at least one fluid conduit of the one or more fluid conduits;

a second intermediate plate axially spaced from the first intermediate plate, wherein the first intermediate plate, the second intermediate plate, and the outer sleeve define a purge air plenum therebetween;

an aft plate axially spaced from the second intermediate plate, wherein the second intermediate plate, the aft plate, and the outer sleeve define a cooling air plenum therebetween, and wherein the outer sleeve defines one or more exhaust ports, the one or more exhaust ports providing fluid communication out of the cooling air plenum;

a plurality of tubes that extends through the forward plate, the fuel plenum, the first intermediate plate, the purge air plenum, the second intermediate plate, the cooling air plenum, and the aft plate;

an annular wall that extends from the second intermediate plate to the aft plate, the annular wall defining a cooling flow channel; and a plurality of apertures defined proximate to a cool side of the aft plate, wherein the plurality of apertures provides for fluid communication between the cooling flow channel and the cooling air plenum.

9. The combustor as in claim 8, wherein the apertures of the plurality of apertures are circumferentially spaced along the annular wall.

10. The combustor as in claim 8, wherein one or more of the apertures of the plurality of apertures includes an outlet oriented towards the cool side of the aft plate.

11. The combustor as in claim 8, wherein the outer sleeve defines an inlet port, wherein the inlet port provides for fluid communication into the purge air plenum.

12. The combustor as in claim 8, further comprising a center fuel nozzle coupled to the end cover, wherein the bundled tube fuel nozzle extends circumferentially around at least a portion of the center fuel nozzle.

13. The combustor as in claim 8, wherein at least one of the one or more exhaust ports is defined along an inner band portion of the outer sleeve.

14. The combustor as in claim 8, wherein at least one of the one or more exhaust ports is defined along an outer band portion of the outer sleeve.

15. A combustor comprising:

an end cover coupled to an outer casing;

a plurality of bundled tube fuel nozzle assemblies disposed within the outer casing and annularly arranged about a center fuel nozzle of the combustor, wherein each bundled tube fuel nozzle assembly is coupled to the end cover, via at least one fluid conduit, and comprises:

a forward plate, a first intermediate plate, and an outer sleeve defining a fuel plenum therebetween, wherein the fuel plenum is in fluid communication with the at least one fluid conduit;

a second intermediate plate axially spaced from the first intermediate plate, wherein the first intermediate plate, the second intermediate plate, and the outer sleeve define a purge air plenum therebetween and wherein the second intermediate plate defines an opening therethrough;

an aft plate axially spaced from the second intermediate plate, wherein the second intermediate plate, the aft plate, and the outer sleeve define a cooling air plenum therebetween;

a plurality of tubes that extends through the forward plate, the fuel plenum, the first intermediate plate, the purge air plenum, the second intermediate plate, the cooling air plenum, and the aft plate, the plurality of tubes being disposed around the opening;

an annular wall that extends from the opening in the second intermediate plate to the aft plate, the annular wall defining a cooling flow channel separate and independent from the plurality of tubes; and a plurality of apertures defined proximate to a cool side of the aft plate, wherein the plurality of apertures provides for fluid communication between the cooling flow channel and the cooling air plenum.

16. The combustor as in claim 15, wherein the apertures of the plurality of apertures are circumferentially spaced along the annular wall.

17. The combustor as in claim 15, wherein one or more of the apertures of the plurality of apertures includes an outlet oriented towards the cool side of the aft plate.

18. The combustor as in claim 15, wherein the outer sleeve defines an inlet port, wherein the inlet port provides for fluid communication into the purge air plenum.

19. The combustor as in claim 15, wherein the outer sleeve defines one or more exhaust ports that provide for fluid communication out of the cooling air plenum.

* * * * *